US006450269B1

(12) United States Patent
Wentworth et al.

(10) Patent No.: US 6,450,269 B1
(45) Date of Patent: Sep. 17, 2002

(54) METHOD AND BIT FOR DIRECTIONAL HORIZONTAL BORING

(75) Inventors: Steven W. Wentworth, Brookfield; Robert F. Crane, Oconomowoc, both of WI (US)

(73) Assignee: Earth Tool Company, L.L.C., Oconomowoc, WI (US)

( * ) Notice: Subject to any disclaimer, the term of this patent is extended or adjusted under 35 U.S.C. 154(b) by 0 days.

(21) Appl. No.: 09/657,353

(22) Filed: Sep. 7, 2000

(51) Int. Cl.[7] ..... E21B 7/05; E21B 10/00; E21B 10/62

(52) U.S. Cl. ..... 175/61; 175/378; 175/398; 175/412

(58) Field of Search ..... 175/61, 62, 334, 175/336, 376, 385, 412, 426, 431, 19, 398, 378

(56) References Cited

U.S. PATENT DOCUMENTS

| | | | | |
|---|---|---|---|---|
| 3,791,463 A | | 2/1974 | Pearson | 175/80 |
| 4,907,658 A | | 3/1990 | Stangl et al. | 175/19 |
| 4,953,638 A | | 9/1990 | Dunn | 175/61 |
| 5,148,880 A | | 9/1992 | Lee et al. | 175/393 |
| 5,253,721 A | | 10/1993 | Lee | 175/73 |
| 5,633,589 A | | 5/1997 | Mercer | 324/326 |
| 5,647,448 A | | 7/1997 | Skaggs | 175/421 |
| 5,778,991 A | | 7/1998 | Runquist et al. | 175/61 |
| 5,795,991 A | | 8/1998 | Hesse et al. | 73/12.09 |
| 5,899,283 A | | 5/1999 | Cox | 175/376 |
| 6,148,935 A | * | 11/2000 | Wentworth et al. | 175/398 |
| 6,247,544 B1 | * | 6/2001 | Beebe | 175/351 |
| 6,250,404 B1 | * | 6/2001 | Gunsaulis | 175/62 |
| 6,260,634 B1 | * | 7/2001 | Wentworth et al. | 175/61 |
| 6,263,983 B1 | * | 7/2001 | Wentworth et al. | 175/19 |

FOREIGN PATENT DOCUMENTS

| | | |
|---|---|---|
| WO | WO 00/11303 | 3/2000 |

* cited by examiner

*Primary Examiner*—David Bagnell
*Assistant Examiner*—Jennifer H Gay
(74) *Attorney, Agent, or Firm*—Edward Jorgenson; Philip G. Meyers Law Office

(57) ABSTRACT

A bit for directional boring according to the invention includes a bit body having a frontwardly facing sloped face effective for steering the bit in dirt. The sloped face defines a steering plane that defines an acute included angle relative to a lengthwise axis of rotation of the bit. A connection is provided at the rear of the bit body permitting the bit to be removably mounted at the lead end of a drill string, and one or more internal passages are provided in the bit body for carrying a drilling fluid to a front end of the bit body. A first cutting tooth is mounted on the bit body and extends frontwardly from the bit body at a first angle that causes the first tooth to cut along a first circular path as the bit rotates. A second cutting tooth is mounted on the bit body and extends frontwardly from the bit body at a second angle that causes the second tooth to cut along a second circular path as the bit rotates, which second path has a diameter greater than the first circular path, and wherein a cutting tip at the front end of the second tooth is rearwardly offset from a cutting tip at the front end of the first tooth. In this manner, the second tooth effectively widen the smaller hole started by the first tooth, resulting in a highly effective rock drilling action. The two teeth may also be used to drill over a limited angle in order to steer the bit in rock, and the sloped face can be used in a known manner to push to steer when the bit is operating in dirt.

17 Claims, 4 Drawing Sheets

METHOD AND BIT FOR DIRECTIONAL HORIZONTAL BORING

TECHNICAL FIELD OF THE INVENTION

The invention relates, in general, to a method and apparatus for directional boring and, in particular to a bit system effective for directional boring in rock.

BACKGROUND OF THE INVENTION

Directional boring machines for making holes through soil are well known. The directional borer generally includes a series of drill rods joined end to end to form a drill string. The drill string is pushed or pulled though the soil by means of a powerful hydraulic device such as a hydraulic cylinder. A spade, bit or chisel configured for boring having an angled steering face is disposed at the end of the drill string, and may include an ejection nozzle for water or drilling mud to assist in boring.

According to one known directional boring system, the drill bit is pushed through the soil without rotation in order to steer the tool by means of the angled face, which is typically a forwardly facing sloped surface. For rocky conditions, a row of teeth may be added to the drill bit and the bit operated in the manner described in Runquist et al. U.S. Pat. No. 5,778,991. Other toothed bits for directional boring through rock are shown in Cox U.S. Pat. No. 5,899,283, Skaggs U.S. Pat. No. 5,647,448 and Stephenson U.S. Pat. No. 5,799,740. As described in Runquist, in rock the drill can be steered cutting an arc or semicircular profile in the desired direction of travel. After the arc is bored, the tool is retracted and rotated back a like distance, or the rotation is completed with the head withdrawn so that no cutting occurs. The tool is then returned to engagement at the same location and the process is repeated. This process may be accomplished manually or by using an automated system such as the NAVTEC® drilling system used on the Vermeer NAVIGATOR® line of drilling machines.

Steering systems for use with these devices require keeping track of the angle of rotation of the sloped face of the bit and/or the teeth. According to one known system, a transmitter or sonde mounted in a tubular housing is mounted behind and adjacent to the bit and sends a signal that indicates the angle of rotation of the bit. The sonde is mounted in a predetermined alignment relative to the steering portion of the bit. See generally Mercer U.S. Pat. Nos. 5,155,442, 5,337,002, 5,444,382 and 5,633,589, Hesse et al. U.S. Pat. No. 5,795,991, and Stangl et al. U.S. Pat. No. 4,907,658. Mounting of the sonde in its housing has been accomplished by end loading or through a side opening which is closed by a door or cover during use, as illustrated in Lee et al. U.S. Pat. Nos. 5,148,880 and 5,253,721.

The "duckbill" style of bit, conventionally mounted directly on a forwardly sloped side face of the sonde housing, is inexpensive, generally easy to replace, and has the advantage of simplicity. Six bolts, which may be countersunk, hold the duckbill in place. The bit itself is little more than a flat steel plate the protrudes beyond the front end of the sonde housing. The bit may have teeth to aid in directional boring through rocky conditions. The bolts that hold the bit on, however, tend to loosen or fail under the large shear forces to which the bit is subjected, and once the bit breaks off, the bore must be discontinued and the drill head withdrawn.

A dual-purpose bit designed for directional boring through soil and horizontal drilling in rock, known as the Trihawk bit, is described in PCT Publication No. 00/11303, published Mar. 2, 2000. The Trihawk bit has three canted teeth set to cut a series of annular grooves which form the outer part of the borehole when drilling in rock. A mound or cone forms at the center of the borehole that is progressively broken down against the steering face as the bit advances. This bit is effective for drilling in dirt, soft rock and medium rock, but has limited drilling capability in hard rock. The present invention provides a bit which has greater durability and rock drilling power than the original Trihawk.

SUMMARY OF THE INVENTION

A bit for directional boring according to the invention includes a bit body having a frontwardly facing sloped face effective for steering the bit in dirt. The sloped face defines a steering plane that defines an acute included angle relative to a lengthwise axis of rotation of the bit. A connection is provided at the rear of the bit body permitting the bit to be removably mounted at the lead end of a drill string, and one or more internal passages are provided in the bit body for carrying a drilling fluid to a front end of the bit body. A first cutting tooth is mounted on the bit body and extends frontwardly from the bit body at a first angle that causes the first tooth to cut along a first circular path as the bit rotates. A second cutting tooth is mounted on the bit body and extends frontwardly from the bit body at a second angle that causes the second tooth to cut along a second circular path as the bit rotates, which second path has a diameter greater than the first circular path, and wherein a cutting tip at the front end of the second tooth is rearwardly offset from a cutting tip at the front end of the first tooth. In this manner, the second tooth effectively widen the smaller hole started by the first tooth, resulting in a highly effective rock drilling action. The two teeth may also be used to drill over a limited angle in order to steer the bit in rock, and the sloped face can be used in a known manner to push to steer when the bit is operating in dirt.

The invention further provides a method for directional drilling in rock with such a bit. The method includes the steps of bringing the bit into contact with a rock face so that a cutting tip of the first tooth engages the rock face, rotating the bit while applying pressure to the bit against the rock face so that the first tooth drills a hole in the rock face while a cutting tip of the second tooth remains free of contact with the rock face, and then continuing rotation of the bit while applying pressure to the bit against the rock face so that the second tooth drills into the rock face, widening the hole started by the first tooth. These and other aspects of the invention are described in detail below.

BRIEF DESCRIPTION OF THE DRAWINGS

Reference is now made to the detailed description of the invention along with the accompanying figures in which corresponding numerals in the different figures refer to corresponding parts, and in which.

DETAILED DESCRIPTION

Figure 1:
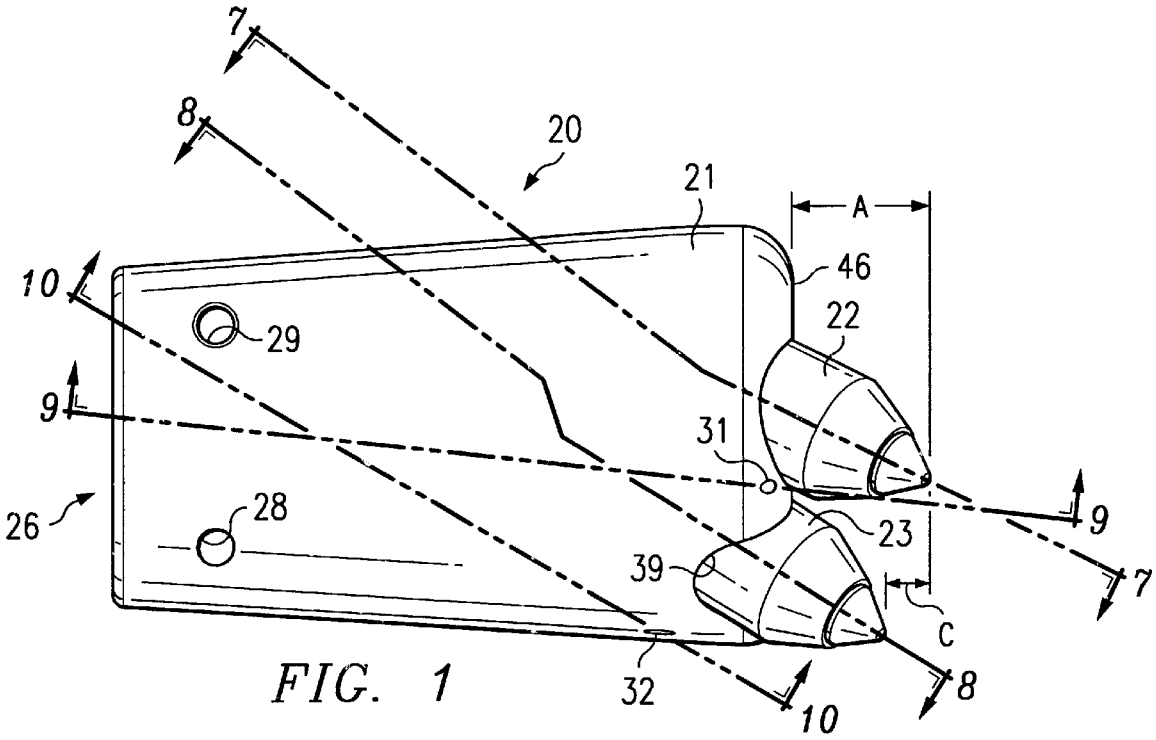
FIG. 1 is a top of a bit of the invention.
Figure 2:
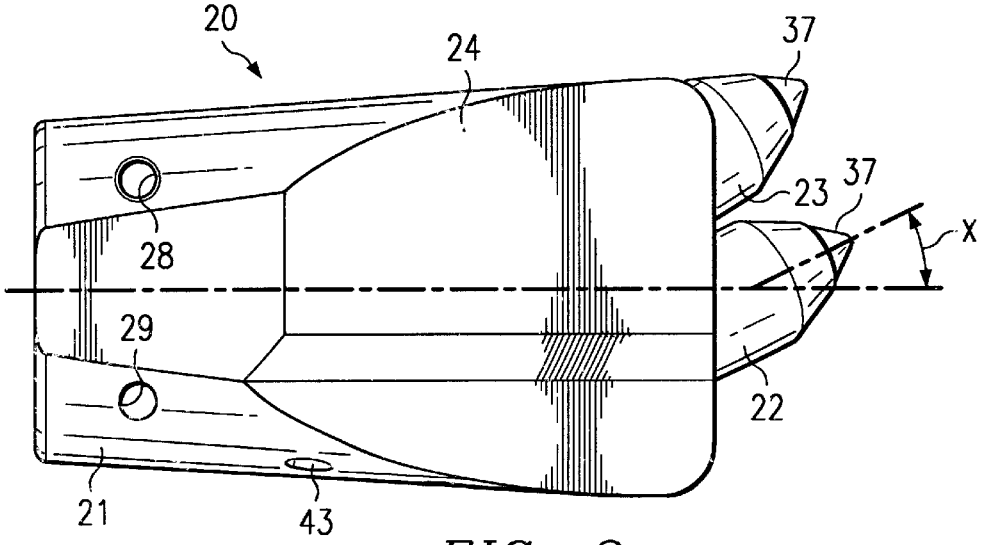
FIG. 2 is a bottom view of the bit of FIG. 1.

Referring now to FIGS. 1–10, a bit 20 according to the invention includes a bit body 21 having a first, long cutting tooth 22 and a second, short cutting tooth 23. Bit body 21 has a frontwardly facing sloped face 24 effective for steering the bit in dirt, which sloped steering face 24 forms a steering plane P that defines an acute included angle relative to a lengthwise axis of rotation R of the bit. Steering plane P is preferably set at an angle in the range of about 10 to 35 degrees relative to the axis of rotation R of the bit.

A rear connection 26 is provided to permit the bit to be removably mounted at the lead end of a drill string. In the illustrated embodiment, connection 26 includes a grooved socket 27 designed to receive a splined projection at the front of an adjoining sonde housing component, as described in commonly-assigned U.S. Ser. No. 09/373,395, filed Aug. 12, 1999 and PCT Publication No. 00/11303, published Mar. 2, 2000, the entire contents of which are incorporated by reference herein for all purposes. A pair of transverse holes 28, 29 on either side of axis R are provided for insertion of roll pins or other retainers that hold bit 20 on the front end of the sonde housing or other adjacent component of the drill head. As described in the foregoing PCT publication, the bit is movable over a short distance relative to the sonde housing so that the pins upon insertion can rotate the bit and preload it in the cutting direction. Connection 26 may in turn comprise a splined projection rather than a socket, or any of a number of known ways to mount a bit known in the art, such as by a threaded connection or an end portion profiled to fit against a surface of the sonde housing with holes therethrough for bolts. Bit 20 also has a pair of internal fluid passages 31, 32 which extend through bit body 21 to carry drilling fluid from socket 27 to a front bit face 33 which adjoins the front end of sloped face 24.

Long tooth 22 comprises a cylindrical steel holder 36A for a conical tungsten carbide tip 37, and shorter tooth 23 similarly comprises a cylindrical steel holder 36B (shorter than 36A) for another conical tungsten carbide tip 37. Each tooth is removably set into respective frontwardly opening holes 38, 39 in front face 33 and secured therein by means of a conventional snap ring, not shown, which engages a small undercut 41 in the wall of each hole. Knockout holes 42, 43 extend from the bottom of each hole 38, 39 to the outer periphery of bit body 21, permitting insertion of a punch to permit manual removal of teeth 22, 23 with a hammer.

In a preferred embodiment, bit 20 has only two teeth 22, 23 rather than three or more, and each tooth is of such a large diameter that no more than two such teeth would fit on the front of the bit body. When the teeth are each formed from a cylindrical steel holder for a tungsten carbide tip, it has been found that use of two teeth permit each tooth holder to be larger in diameter and much more resistant to wear than the smaller teeth that must be used when three or more teeth of this kind are used. Kennemetal C-4 trencher teeth are suitable for use in the present invention. Teeth 22, 23 are free to rotate in holes 38 and 39, and carbide tips 37 have a conical (symmetrical) shape tapering at an angle suitable for shearing or chip cutting in soft, medium, or even hard rock.

Figure 3:
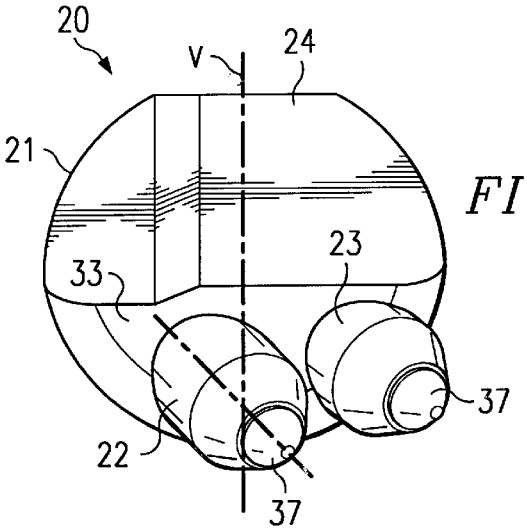
FIG. 3 is a front view of the bit of FIG. 1.
Figure 4:
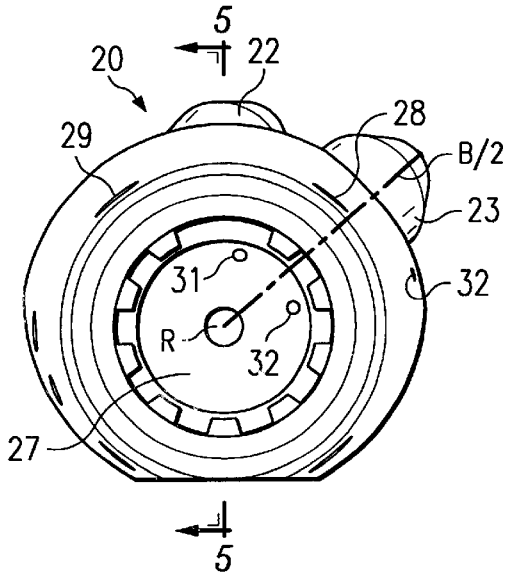
FIG. 4 is a rear view of the bit of FIG. 1.
Figure 5:
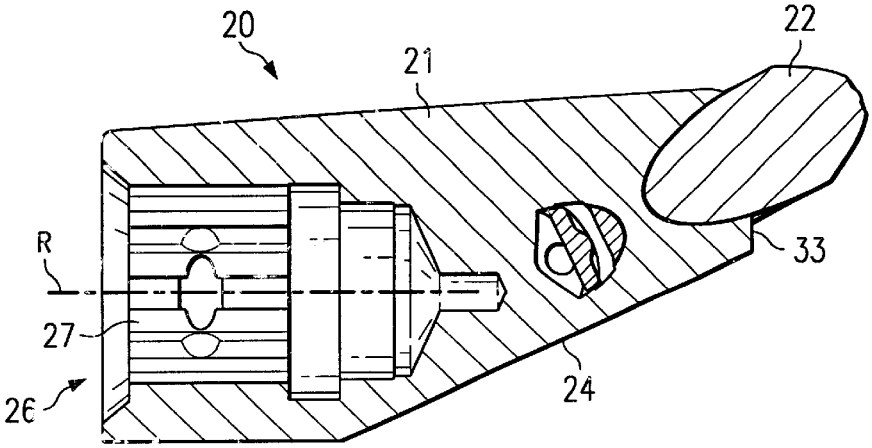
FIG. 5 is a sectional view along the line 5—5 in FIG. 4.
Figure 6:
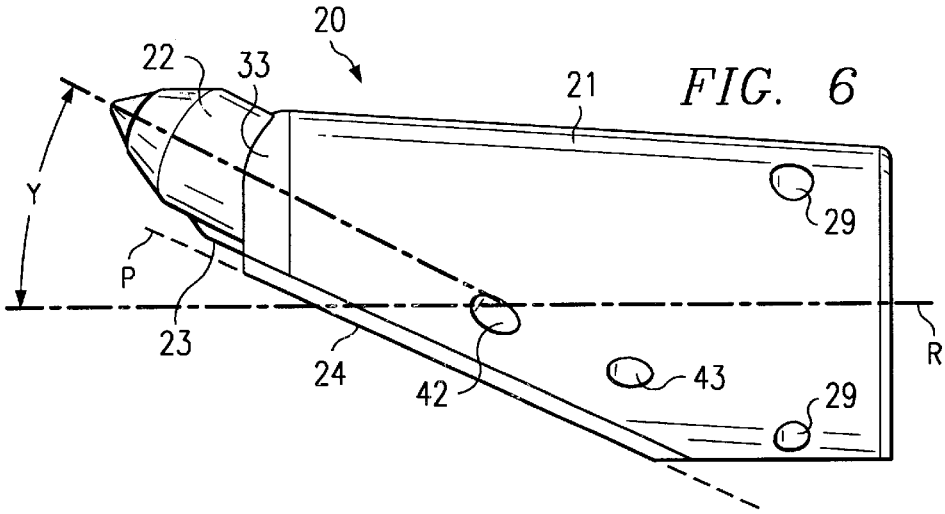
FIG. 6 is a side view of the bit of FIG. 1.
Figure 7:
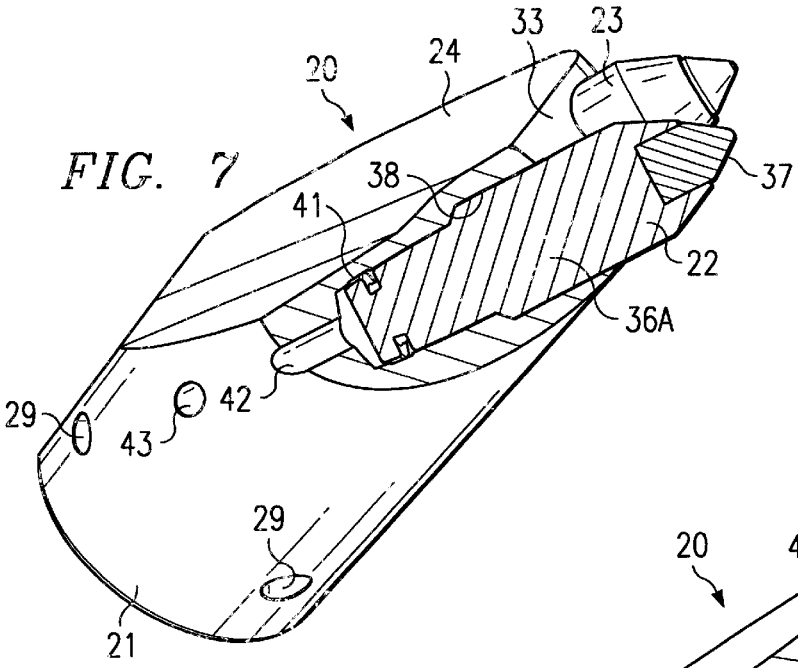
FIG. 7 is a sectional view along the line 7—7 in FIG. 1.
Figure 8:
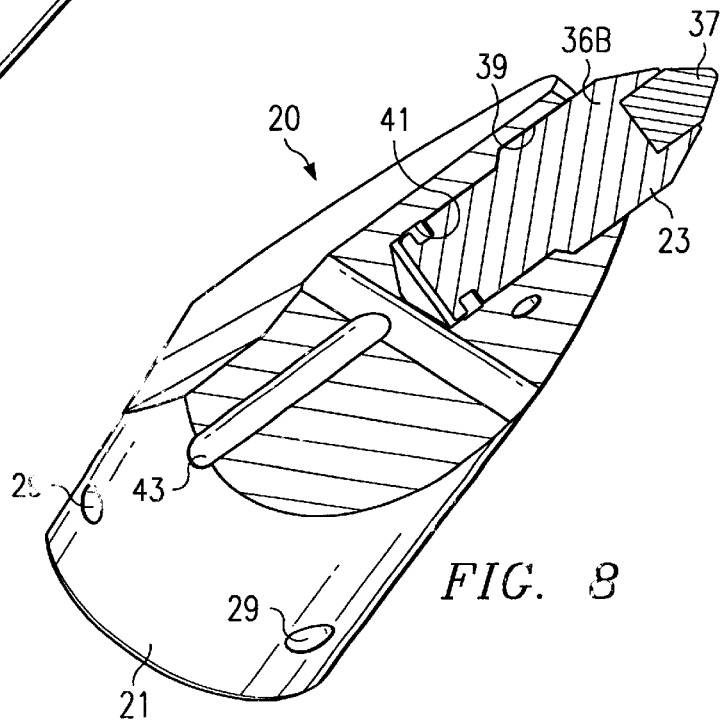
FIG. 8 is a sectional view along the line 8—8 in FIG. 1.
Figure 9:
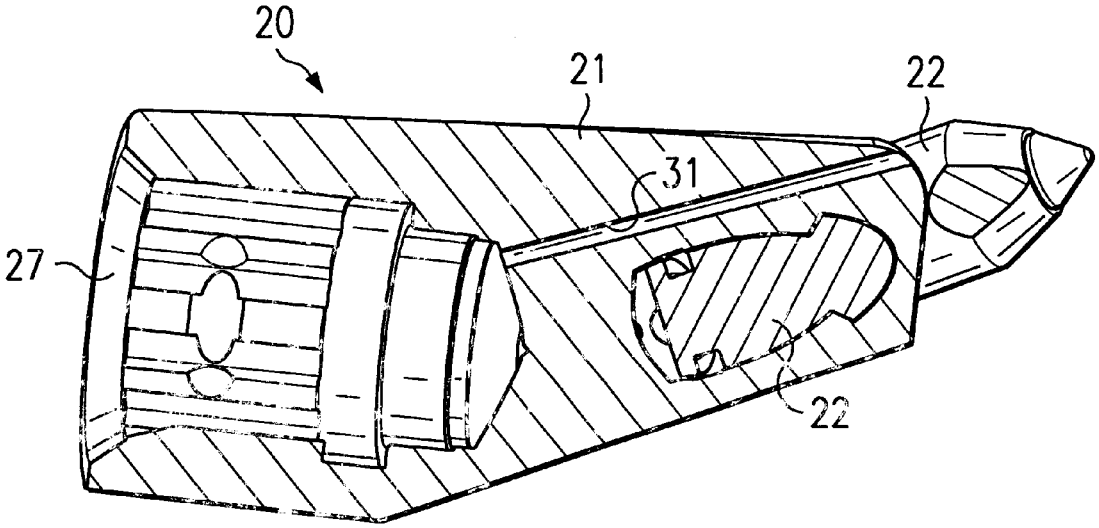
FIG. 9 is a sectional view along the line 9—9 in FIG. 1.
Figure 10:
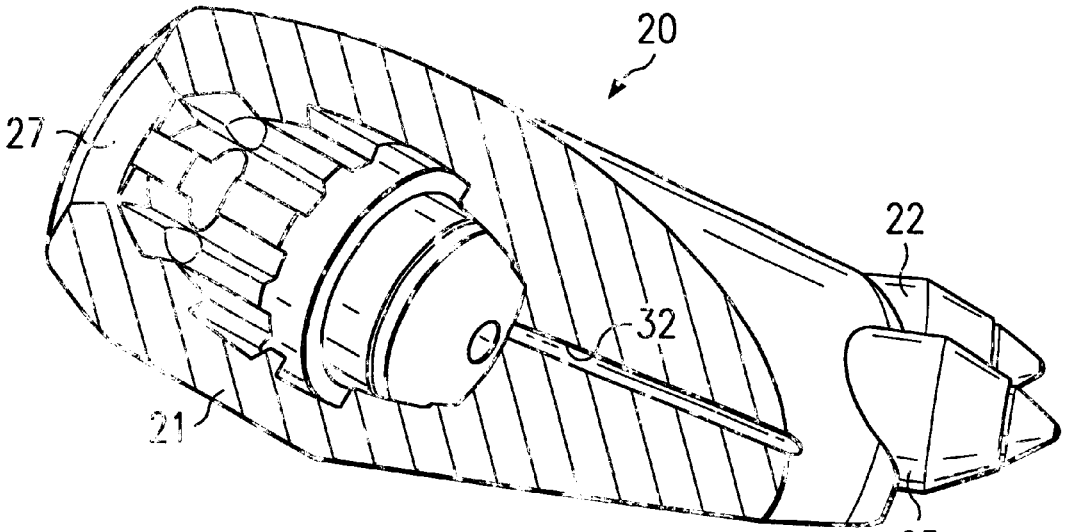
FIG. 10 is a sectional view along the line 10—10 in FIG. 1.

As shown in FIG. 3, teeth 22, 23 are each angled outwardly and are canted in a common cutting direction. Most preferably. the lengthwise axes of the first and second teeth 22, 23 are parallel or nearly parallel to one another and to the steering plane P as shown in FIG. 6. In this context, "nearly parallel" means the lengthwise tooth axes intersect to define an angle of 10° or less. The angles at which teeth 22, 23 extend as shown in FIG. 3 each have two directional components, a first or lateral angle X (FIG. 2) and a second or radial angle Y (FIG. 6). As to angle Y, teeth 22, 23 are preferably each angled from 10 to 45 degrees outwardly in a direction away from the steering face 24. Angle X is similarly preferably from 10 to 45 degrees in the cutting direction, and angles X, Y may be the same or different for each tooth 22, 23. Most preferably, angles X, Y for each tooth are each in the range of from 20–40°.

The length of each tooth 22, 23 is important to the present invention. Long tooth 22 is preferably long enough so that it crosses over a vertical plane V (FIG. 3) that bisects sloped steering face 24 and intersects the axis of rotation R of bit 20. In particular, a set of ratios have been derived which ensure that the circular drilling paths traced by each tooth 22, 23 as described above are of optimum size. As shown in FIG. 1, if A is the distance in the lengthwise direction of bit 20 between the front end of the first tooth 22 and the front end 46 of bit body 21, B is the diameter of the second circular path traced by tooth 23 during drilling, and C is the distance in the lengthwise direction of bit 20 between the front end (tip) of first tooth 22 and the front end or tip of second tooth 23, then the ratio A/B is preferably in the range of about 0.25 to 0.6, and the ratio C/B is preferably in the range of about 0.07 to 0.3. These ratios assure that the longer tooth 22 drills an initial hole in rock that is effectively widened when the second tooth comes into contact with the rack face.

As such, in contrast to the TRIHAWK® drill bit described above, the bit of the invention forms a generally concave working face in the borehole when drilling in rock (the opposite of leaving a mound or cone projecting from the rock face during drilling). This has been found to increase drilling efficiency while reducing wear of the bit body and teeth. However, the concavity should not be so deep that it interferes with steering of the bit according to the "NAVTEC®" method now in use with the Vermeer NAVIGATOR® line of directional drilling machines.

The bit body of the TRIHAWK® drill bit is set with numerous carbide studs to protect against abrasion and grind cuttings. These studs are installed manually and add considerably to the cost of the bit. The bit body 21 according to the present invention wears well even without any carbide body studs, providing further advantages over known horizontal directional drilling bits. Bit body 21 has an outer diameter suitable for horizontal directional drilling applications, generally in a range of about 2 to 10 inches. It is not required that the bit body have a rear crushing zone as described in the foregoing PCT publication, and as such the rear end of bit body 21 may have the same diameter as the adjoining front end of the sonde housing. In the illustrated embodiment, bit body 21 has a frustoconical (sawed off cone) shape that widens towards the front. However, this is not essential for purposes of the invention and a variety of body shapes can be employed, as long as the hole drilled is of greater diameter than the sonde housing.

While certain embodiments of the invention have been illustrated for the purposes of this disclosure, numerous changes in the method and apparatus of the invention presented herein may be made by those skilled in the art, such changes being embodied within the scope and spirit of the present invention as defined in the appended claims.

What is claimed is:

1. A bit for directional boring, comprising:

a bit body having a frontwardly facing sloped face effective for steering the bit in dirt, which sloped face defines a steering plane that defines an acute included angle relative to a lengthwise axis of rotation of the bit, a rear connection permitting the bit to be removably mounted at the lead end of a drill string, and an internal passage for carrying a fluid to a front end of the bit body;

a first cutting tooth mounted on the bit body and extending frontwardly from the bit body at a first angle that causes the first tooth to cut along a first circular path as the bit rotates; and a second cutting tooth mounted on the bit body and extending frontwardly from the bit body at a second angle that causes the second tooth to cut along a second circular path as the bit rotates, which second path has a diameter greater than the first circular path, and wherein a cutting tip at the front end of the second tooth is rearwardly offset from a cutting tip at the front end of the first tooth.

2. The bit of claim 1, wherein the cutting teeth comprise carbide cutting tips mounted in cylindrical steel holders, which holders are removably mounted in frontwardly opening holes in the bit body.

3. The bit of claim 2, wherein the bit has a front end face which adjoins the sloped steering face, wherein the frontwardly opening holes are located on the front end face.

4. The bit of claim 2, wherein at least one internal passage for carrying a fluid opens on the front end face.

5. The bit of claim 2, wherein the cutting tips have a conical cutting surface.

6. The bit of claim 1, wherein the first and second teeth are each angled outwardly and are canted in a common cutting direction.

7. The bit of claim 6, wherein lengthwise axes of the first and second teeth are parallel or nearly parallel to one another and to the steering plane.

8. The bit of claim 6, wherein the first and second teeth are each angled at from 10 to 45 degrees outwardly in a radial direction away from the steering face and from 10 to 45 degrees in the cutting direction, wherein each angle may be the same or different for each tooth.

9. The bit of claim 1, wherein lengthwise axes of the first and second teeth are parallel or nearly parallel to one another and to the steering plane.

10. The bit of claim 1, wherein when the bit is oriented for horizontal directional drilling, a lengthwise axis of the first tooth crosses over a first vertical plane that bisects the sloped steering face and intersects the axis of rotation of the bit.

11. The bit of claim 1, wherein the first and second angles each extend in a vertical direction away from the steering face and in a common horizontal cutting direction.

12. The bit of claim 11, wherein the first and second teeth are each angled at from 10 to 45 degrees outwardly in the vertical direction away from the steering face and from 10 to 45 degrees in the horizontal cutting direction, wherein each angle may be the same or different for each tooth.

13. The bit of claim 12, wherein the bit body has an outer diameter in the range of about 2 to 10 inches.

14. The bit of claim 1, wherein the ratio of the distance in the lengthwise direction of the bit between the front end of the first tooth and the front end of the bit body to the diameter of the second circular path is in the range of about 0.25 to 0.6 and the ratio of the distance in the lengthwise direction of the bit between the front end of the first tooth and the front end of the second tooth to the diameter of the second circular path is in the range of about 0.07 to 0.3.

15. The bit of claim 14, wherein the steering plane is set at an angle in the range of about 10 to 35 degrees relative to the axis of rotation of the bit.

16. A bit for directional boring, comprising:

a bit body having a frontwardly facing sloped face effective for steering the bit in dirt, which sloped face defines a steering plane that defines an acute included angle relative to a lengthwise axis of rotation of the bit, a rear connection permitting the bit to be removably mounted at the lead end of a drill string, a front end face which adjoins the sloped steering face, and an internal passage for carrying a fluid to a front end of the bit body;

a first cutting tooth mounted on the bit body and extending frontwardly from the bit body at a first angle that causes the first tooth to cut along a first circular path as the bit rotates, which first tooth comprises a carbide cutting tip mounted in a cylindrical steel holder, which holder is removably mounted in a first frontwardly opening hole in the front end face of the bit body; and a second cutting tooth mounted on the bit body and extending frontwardly from the bit body at a second angle that causes the second tooth to cut along a second circular path as the bit rotates, which second path has a diameter greater than the first circular path, wherein the first and second angles each extend in a vertical direction away from the steering face and in a common horizontal cutting direction and are substantially parallel to one another, which second tooth comprises a carbide cutting tip mounted in a cylindrical steel holder, which holder is removably mounted in a second frontwardly opening hole in the front end face of the bit body, and the cutting tip at the front end of the second tooth is rearwardly offset from the cutting tip at the front end of the first tooth.

17. A method for directional drilling in rock with a bit that includes a bit body having a frontwardly facing sloped face effective for steering the bit in dirt, which sloped face defines a steering plane that defines an acute included angle relative to a lengthwise axis of rotation of the bit, and a rear connection permitting the bit to be removably mounted at the lead end of a drill string, a first cutting tooth mounted on the bit body and extending frontwardly from the bit body at a first angle that causes the first tooth to cut along a first circular path as the bit rotates, and a second cutting tooth mounted on the bit body and extending frontwardly from the bit body at a second angle that causes the second tooth to cut along a second circular path as the bit rotates, which second path has a diameter greater than the first circular path, and wherein a cutting tip at the front end of the second tooth is rearwardly offset from a cutting tip at the front end of the first tooth, comprising the steps of:

bringing the bit into contact with a rock face so that the cutting tip of the first tooth engages the rock face;

rotating the bit while applying pressure to the bit against the rock face so that the first tooth drills a hole in the rock face while the cutting tip of the second tooth remains free of contact with the rock face; and continuing rotation of the bit while applying pressure to the bit against the rock face so that the second tooth drills into the rock face, widening the hole started by the first tooth.

* * * * *